United States Patent [19]

Chuss et al.

[11] 4,201,315

[45] May 6, 1980

[54] EMPTY HOPPER DETECTOR

[75] Inventors: David M. Chuss; Benjamin H. Pinckney, both of Bethlehem, Pa.

[73] Assignee: Bethlehem Steel Corporation, Bethlehem, Pa.

[21] Appl. No.: 957,514

[22] Filed: Nov. 3, 1978

[51] Int. Cl.[2] ..... F27D 3/00

[52] U.S. Cl. ..... 222/66; 340/617; 141/392

[58] Field of Search ..... 340/614, 617, 627; 222/52, 64, 65, 66; 141/387, 392

[56] References Cited

U.S. PATENT DOCUMENTS

| | | | |
|---|---|---|---|
| 2,212,865 | 8/1940 | Kirk | 340/617 X |
| 2,489,498 | 11/1949 | Palmer . | |
| 2,902,188 | 9/1959 | Tarukawa | 222/65 X |
| 3,019,310 | 1/1962 | Hoff | 340/617 X |
| 3,368,948 | 2/1968 | Meunier et al. . | |

FOREIGN PATENT DOCUMENTS

| | | | |
|---|---|---|---|
| 619975 | 5/1961 | Italy | 222/64 |

*Primary Examiner*—David A. Scherbel
*Attorney, Agent, or Firm*—Joseph J. O'Keefe; John J. Selko

[57] ABSTRACT

A pivotable probe arm in a batch hopper automatically indicates when the hopper is empty, and in an alternate embodiment, also automatically closes the discharge opening when the hopper is empty.

5 Claims, 6 Drawing Figures

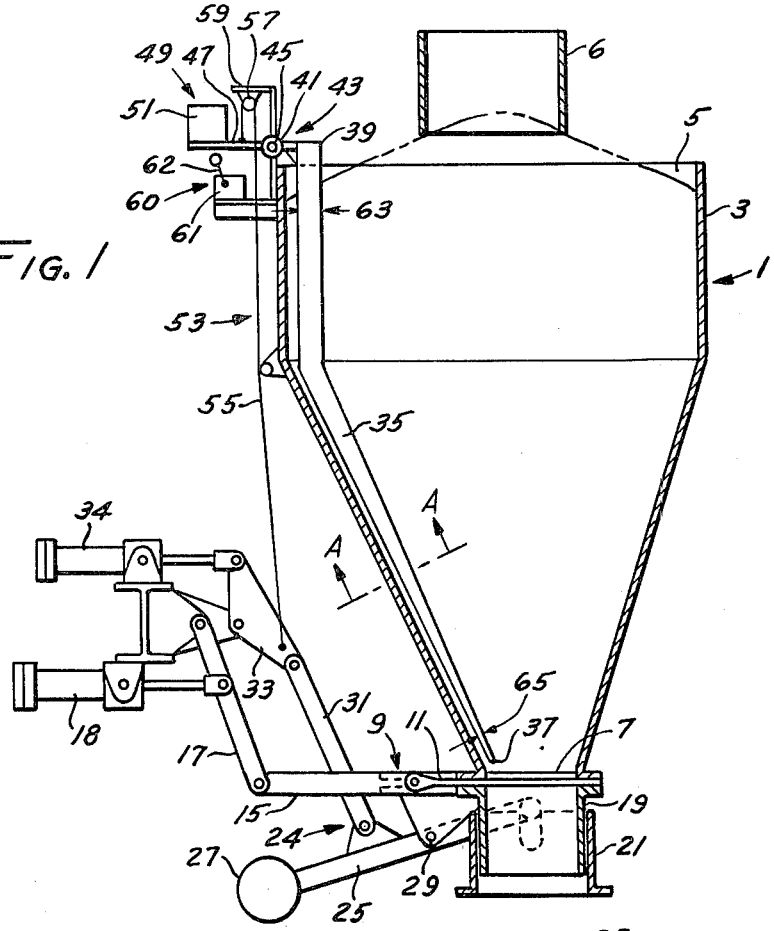
FIG. 1
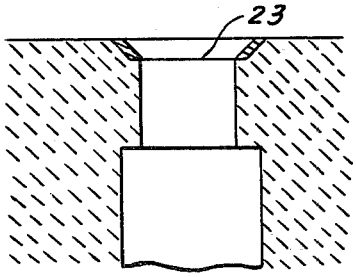
FIG. 3
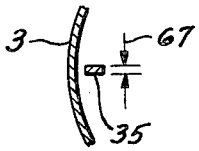

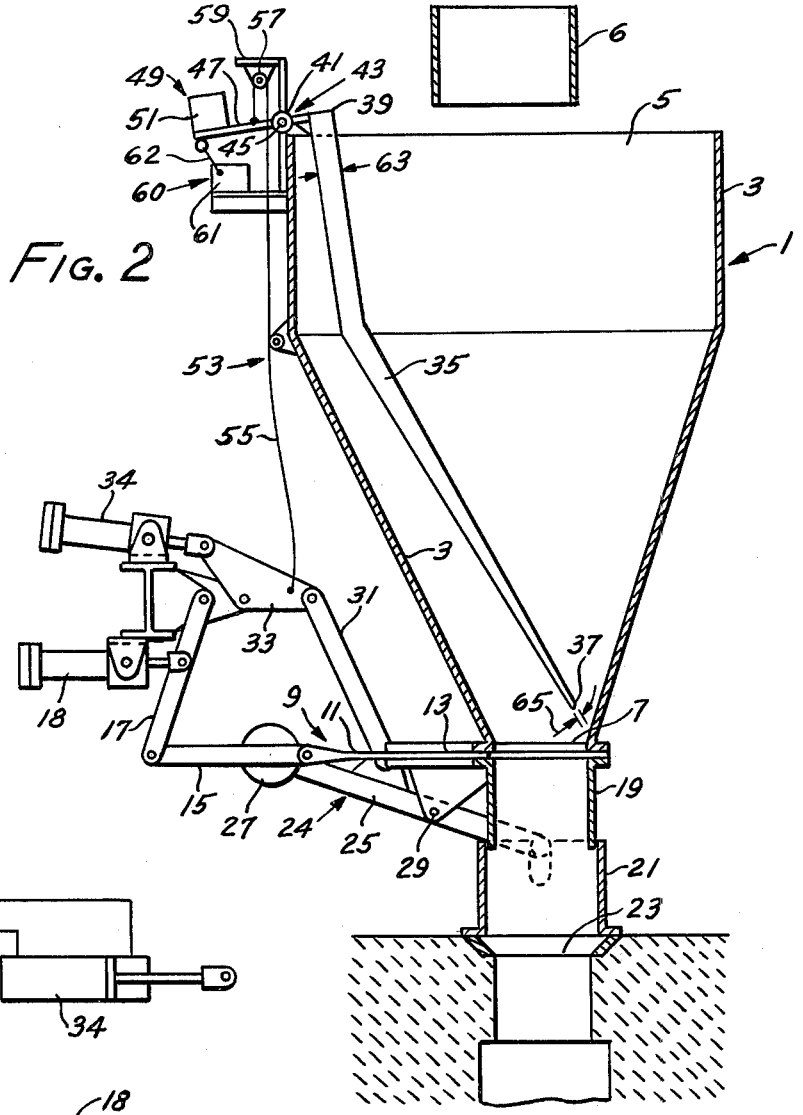
FIG. 2
FIG. 5
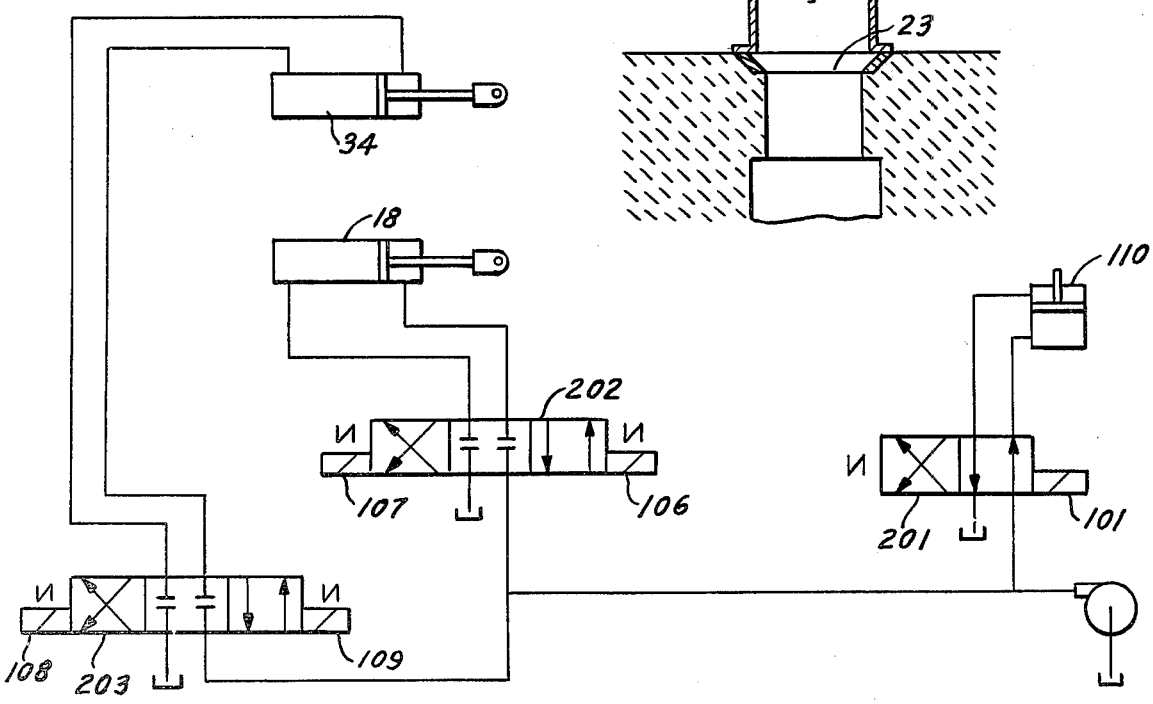

HOPPER c
HOPPER b
HOPPER a
+
-
LINE
1
2
3
4
5
6
7
8
9
10
11
12
13
14
15
16
17
18
19
20
21
22
23
24
304-1a
304-1b
304-1c
101
304-2a
304-2b
304-2c
316
61
310
103
304
102
305
104
308
105
309
312-1
109
312-2
311-1
107
311-2
315-2
310-3
308-2
311
314-1
308-1
304-3
312
315-1
313
314
304-4
314-2
308-3
301
302
302-1
302-2
303-1
108
303-2
307-1
106
307-2
306-2
302-3
305-3
303
310-1
305-1
309-1
307
310-2
305-2
306
306-1

EMPTY HOPPER DETECTOR

BACKGROUND OF THE INVENTION

In the charging of coke ovens with crushed coal, larry cars move upon the top of the coke ovens to position batch-type hoppers over charging holes through which coal is charged. Such hoppers are usually gravity operated, although a discharging device, such as a screw-feed or table-feed mechanism can be used.

During the charging operation, the larry car operator must be able to detect when hoppers are empty in order to quickly close the hopper discharge opening of each hopper, to prevent escape of charging emissions, and also to prevent damage to the hopper interior from any hot gases which may escape from the coke oven. In order to avoid the need for such operators to leave their air conditioned cabs to detect when hoppers are empty, a reliable indicating device is needed. Such device must be capable of automatically indicating when hoppers are empty, be of rugged construction and designed so that the device itself does not contribute to or cause arching or hang-up of material within the hopper. In addition, it would be desirable for such device to automatically close the discharge opening of the hopper, as soon as the hopper is empty.

SUMMARY OF THE INVENTION

It is the object of this invention to satisfy the need for such indicators by providing an improvement to a larry car batch hopper for signalling when the hopper is empty, including a pivotable probe arm extending within the hopper, biasing means to cause the probe arm to pivot when the hopper empties, to activate signalling devices, means for locking the probe arm against the interior of the side walls when the hopper is empty and unlocking the probe arm after the hopper is filled, for pivoting upon discharge of the hopper. An alternate embodiment provides means for automatically closing the hopper discharge opening, as soon as the hopper is empty, in addition to indicating when the hopper is empty.

BRIEF DESCRIPTION OF THE DRAWINGS

FIG. 1 shows a cross sectional elevation of a hopper embodying the invention with parts of the larry car frame not shown, and the probe arm locked against the wall of a hopper containing coal.

FIG. 2 shows a cross sectional elevation of a hopper embodying the invention with parts of the larry car frame removed, and the probe arm pivoted away from the hopper wall to indicate an empty hopper.

FIG. 3 shows a cross section along lines A—A of FIG. 1.

FIG. 5 shows a schematic hydraulic diagram of the alternate embodiment of the invention for automatically closing the hopper discharge opening, as well as indicating when the hopper is empty.

DETAILED DESCRIPTION OF THE PREFERRED EMBODIMENT

Figure 4:
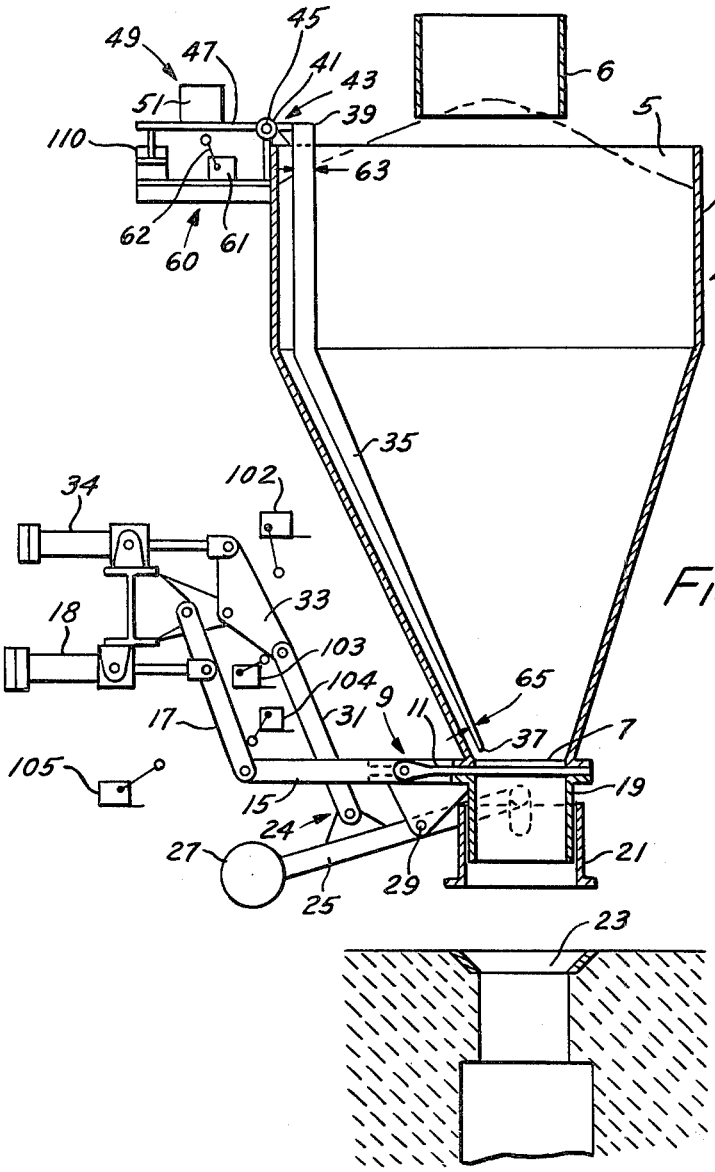
FIG. 4 shows a cross-sectional elevation of an alternate embodiment of a hopper of the invention with parts of the larry car frame removed.

Referring to FIGS. 1 and 2, the preferred embodiment and best mode of the invention are described hereinafter.

A gravity operated batch hopper 1 is shown having sidewalls 3 forming a top charging opening 5. Charging rings 6 assist in the effective charging of coal into hopper 1, as is well known, and are optional. Sidewalls 3 converge downwardly to form bottom discharge opening 7, as is well known. Closure means 9 includes sliding plate 11 which reciprocates back and forth in passageway 13 to open and close discharge opening 7. Linkage arms 15 and 17 are pivotably connected to reciprocate sliding plate 11 back and forth, as is well known, and conventional linkage arms 15 and 17 are driven by any conventional means such as hydraulic cylinder 18.

Beneath bottom discharge opening 7 is a lower extension 19 having the same internal dimension as the bottom discharge opening 7, as is conventional.

Slidably telescoped over lower extension 19 is movable drop sleeve 21 which can be raised and lowered. When drop sleeve 21 is lowered, it contacts coke oven charging opening 23 and together with lower extension 19 forms a conduit for coal to fall into the coke oven.

Drop sleeve 21 is raised and lowered by conventional mechanical linkage means 24 including linkage arm 25 pivotably connected at one end to drop sleeve 21 and having counterweight 27 at the other end. Linkage arm 25 is pivotably mounted on hopper 1 at pivot point 29 and is further pivotably connected to second linkage arm 31, which is in turn connected to third linkage arm 33.

Linkage arms 25, 31 and 33 move at the urging of conventional hydraulic cylinder 34 to lower drop sleeve 21 into engagement with charging hole 23. When the hydraulic cylinder 34 is extended, drop sleeve 21 is raised. Counterweight 27 facilitates the raising of drop sleeve 21.

It should be understood that these above described features are well known and conventional and do not in themselves describe the invention herein. Other equivalent arrangements to accomplish the above described functions are also possible.

The hopper 1 with closure means 9 are mounted on a conventional larry car frame which provides motive power for moving hopper 1 back and forth upon the coke oven battery. It is also understood that the larry car includes from three to five of such hoppers, and that the description of one such hopper 1 applies equally to all other such hoppers.

Pivotable probe arm 35 extends downwardly within hopper 1 adjacent a portion of the interior of sidewall 3. Probe arm 35 terminates in a lower end 37 adjacent discharge opening 7 and an upper end 39 spaced upwardly from lower end 37, preferably adjacent charging opening 5. Lower end 37 should extend to within a few inches of discharge opening 7. Probe arm 35 is connected to housing 41 which is pivotable about pivot means 43 which includes shaft 45 mounted on sidewall 3 and arm 47 extending opposite of upper end 39 outside hopper 1. Mounted on arm 47 is biasing means 49 including counterweight 51 of sufficient weight to cause probe arm to pivot away from hopper sidewall 3 when hopper 1 is substantially empty. The weight of counterweights 51 should be selected so that pressure from a small amount of coal in the bottom of hopper 1 upon lower end 37 will prevent probe arm 35 from pivoting.

Locking means 53 includes a cable 55 connected at one end to linkage arm 33 which forms part of the mechanical linkage means 24 for raising and lowering drop sleeve 21. Cable 55 extends upwardly about a pulley 57 located on bracket 59 above counterweight 51. Cable 55 is connected at the other end to arm 47 or counterweight 51. The cable length is adjusted so that it is taut and locks counterweight 51 in a raised position, and thereby locks probe arm 35 against sidewall 3, when drop sleeve 21 is raised as shown in FIG. 1.

As shown in FIG. 2, when drop sleeve 21 is lowered, cable 55 becomes slack because linkage arm 33 is raised, thereby unlocking counterweight 51 to permit it to move probe arm 35 away from sidewalls 3 when hopper is empty. Of course, when hopper 1 contains coal, the coal therein presses probe arm 35 against sidewall 3 even though cable 55 is slack, and only after the coal is discharged does probe arm 35 move away from sidewalls 3 in response to the downward movement of counterweight 51.

Located outside hopper 1 on sidewall 3 below counterweight 51 is conventional electrical switch means 60 including a normally open switch 61 having contact arm 62.

Switch 61 is electrically connected by conventional means to signalling device, such as a light, 316 (FIG. 6), located in the operator's cab, or other visible location.

When counterweight 51 lowers, and probe arm 35 moves, as when hopper 1 is empty, switch 61 closes to activate a signalling device to indicate hopper 1 is empty. When counterweight 51 raises and probe arm 35 pivots toward sidewalls 3 switch 61 opens to deactivate a signalling device.

Probe arm 35 has a thickness dimension 63 at upper end 39 sufficient to provide stiffness to probe arm 35, in order to prevent bowing of probe arm 35 when hopper is full or partially full, and probe arm 35 is unlocked, and counterweight 51 tends to pivot downwardly. Probe arm 35 tapers downwardly to a second thickness dimension 65 at lower end 37.

This tapered configuration of probe arm 35 reduces any tendency of probe arm 35 to cause blockage to flow out discharge opening 7. As shown in FIG. 3, probe arm 35 has a minimal width dimension 67 in comparison to its thickness dimension 63, again in order to minimize any tendency to obstruct free flow of coal. Minimizing blockage to coal flow is an extremely important feature of this invention, since charging of crushed coal by gravity is peculiarly susceptible to arching or blockage, and such arching is extremely deleterious to coke oven charging with regard to emissions and damage to equipment from hot gases escaping from the coke oven. I prefer to make thickness dimension 63 about 3 inches (76.2 mm.), thickness dimension 65 about $\frac{3}{8}$ inches (9.5 mm.) and width dimension 67 about $\frac{3}{8}$ inches (9.5 mm.). Probe arm 35 is preferred to be of stainless steel.

Probe arm 35 should be shaped to conform to the interior slope of sidewalls 3, when positioned adjacent thereto, again to minimize obstruction to coal flow.

As shown in FIGS. 1 and 2, sidewalls 3 converge downwardly at about the same angle to the horizontal. It is not uncommon for one portion of sidewall 3 to converge downwardly at a different angle to the horizontal than an opposite, or somewhat removed, sidewall portion. Should this condition pertain, probe arm 35 should be mounted adjacent the portion of sidewall 3 which is least sloped, i.e. has the smallest angle to horizontal, for most effective performance.

Figure 6:
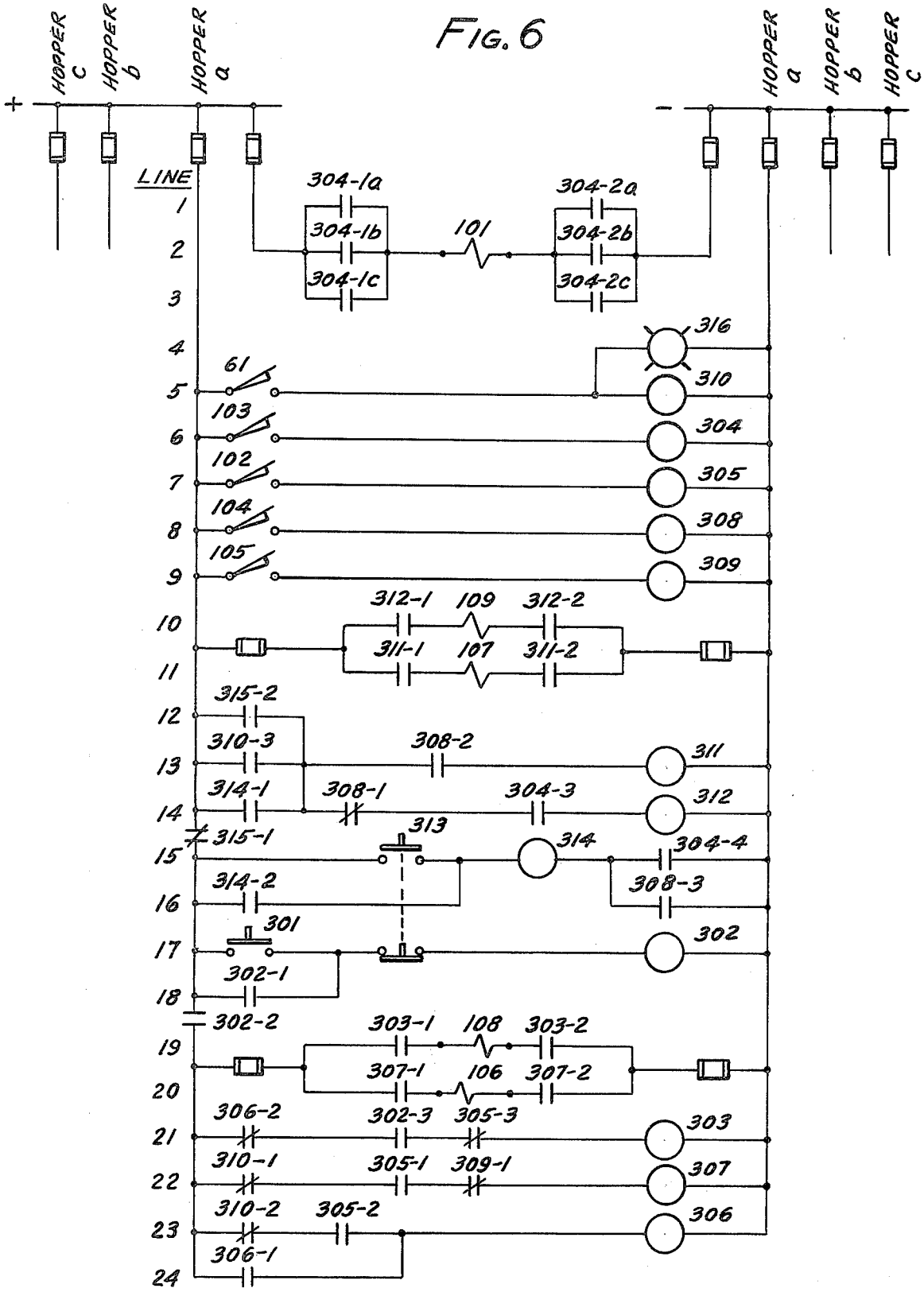
FIG. 6 shows an electrical schematic diagram for the alternate embodiment of the invention for automatically closing the hopper discharge opening, as well as indicating when the hopper is empty.

FIGS. 4, 5 and 6 describe an alternate embodiment of the invention wherein the locking and unlocking of probe arm 35, opening and closing of closure means 9 and signalling of empty hopper are all automatically performed after initiation of a discharge cycle.

FIG. 6 shows the preferred electronic logic for wiring the limit switch 61 to controls for automatic operation of a drop sleeve 21 and slide gate 11 for a single hopper 1*a* on a larry car having three such hoppers, each such hopper referred to hereinafter as 1-*a*, 1-*b*, and 1-*c*, respectively. Circuitry for the additional hoppers would be identical to that represented by lines 4 through 24 of FIG. 6 shown herein. The relay contacts in FIG. 6 are positioned as shown when the hopper 1 is full and the larry car is spotted for charging, as shown in FIG. 4. The following is the described manner in which the electrical components in FIG. 6 automatically shift the hydraulic valve spools shown in FIG. 5 for the slide gate 11 and drop sleeve 21.

With a full hopper 1 positioned over an open charging opening 23, the operator pushes button 301 (FIG. 6, Line 17) in the cab to start a discharging cycle for the hopper 1*a*. When pushed, button 301 closes circuit to relay coil 302, which in turn closes relay contacts 302-1, 302-2, and 302-3 (Lines 18 and 21). Relay coil 303 (Line 21) is now energized and closes contacts 303-1 and 303-2 (Line 19) to energize solenoid 108 (FIG. 5).

When energized, solenoid 108 shifts hydraulic valve spool 203 (from FIG. 5) to pressurize the rod end of hydraulic cylinder 34, causing drop sleeve 21 to lower. As drop sleeve 21 lowers, linkage 33 moves away from limit switch 103, permitting limit switch 103 to energize relay coil 304 (Line 6 —FIG. 6). The energized coil 304 then closes contacts 304-1*a* and 304-2*a* (Line 1) to energize solenoid 101 (FIG. 5), which shifts hydraulic spool 201. When spool 201 shifts, the rod end of cylinder 110 retracts from contacting arm 47, thereby unlocking probe arm 35 for pivoting. However, probe arm 35 does not yet pivot since it is held against hopper wall 3 by coal in hopper 1. In addition to closing contacts 304-1*a* and 304-2*a*, relay coil 304 also closed contacts 304-3 (Line 14) and 304-4 (Line 15).

Probe arm 35 will stay unlocked for pivoting as long as the drop sleeves of hoppers 1-*b* or 1-*c* are down during the discharging sequence. Contacts 304-1*b*, 304-2*b*, 304-1*c*, and 304-2*c* (Lines 2 and 3) are closed when other limit switches, such as limit switch 103, are not contacted by drop sleeve linkages, such as linkage 33, on the other hoppers 1-*b* or 1-*c*. Thus contacts 304-1*a*, 304-2*a*, 304-1*b*, 304-2*b*, 304-1*c* and 304-2*c* must all be open to cut out power to solenoid 101 to shift hydraulic valve spool, 201, to extend cylinder 110 up against contact arm 47 of each of hoppers 1-*a*, 1-*b*, and 1-*c*, to reset probe arm 35 against hopper wall 3. This feature will allow indicating light 316 on each hopper to show the operator which of hoppers 1-*a*, 1-*b*, or 1-*c* are empty throughout the discharging cycle.

When drop sleeve 21 is fully lowered, linkage 33 contacts limit switch 102, which in turn closes circuit to relay coil 305 (FIG. 6, Line 7) causing contacts 305-1 (Line 22) and 305-2 (Line 23) to close, and contacts 305-3, (Line 21) to open. When contacts 305-3 open, power is cut off to relay coil 303, thereby opening contacts 303-1 and 303-2 (Line 19) to open circuit for solenoid 108 (FIG. 5). Hydraulic valve spool 203 is then shifted to the neutral position by solenoid 108 to stop cylinder 34 lowering drop sleeve 21.

When contacts 305-2 (Line 23) are closed, relay coil 306 closes contacts 306-1 (Line 24) and opens contacts 306-2 (Line 21).

Also, when contacts 305-1 close, relay coil 307 closes contacts 307-1 and 307-2 (Line 20) to energize solenoid 106 (FIG. 5). This solenoid then shifts hydraulic valve spool 202 to retract cylinder 18 rod to pull back linkage 17 connected to slide gate 11. As the slide gate 11 opens, linkage 17 moves away from limit switch 104 (Line 8, FIG. 6), which in turn, closes the circuit for relay coil 308. The coil then opens contacts 308-1 (Line 14) and closes contacts 308-2 (Line 2) and contacts 308-3 (Line 16).

When the slide gate 11 is fully retracted, linkage 17 contacts limit switch 105 (Line 9), causing contacts in the switch to close and energize relay coil 309. The relay coil 309 then opens contacts 309-1 (Line 22) to cut off power to relay coil 307. which in turn opens contacts 307-1 and 307-2 (Line 20). The opened contacts now cause the solenoid 106 to shift hydraulic valve spool 202 to neutral position so that cylinder 18 stops retracting slide gate 11.

When coal recedes below the probe arm 35, contact arm 47 closes limit switch 61 causing relay coil 310 (Line 5) to be energized and indicator light 316 (line 4) to go on. The relay coil then opens contacts 310-1 (Line 22) and 310-2 (Line 23) and closes contacts 310-3 (Line 13) which, in turn, closes the circuit to relay coil 311 (Line 13). This relay coil then closes contacts 311-1 and 311-2 (Line 11) to energize solenoid 107 (FIG. 5). The solenoid then shifts hydraulic valve spool 202 to extend cylinder 18 rod thereby closing slide gate 11. When slide gate 11 begins to close, linkage 17 moves off limit switch 105, which in turn causes relay coil 309 to close contacts 309-1 (Line 22).

When the slide gate 11 is fully closed, linkage 17 contacts limit switch 104 to open the circuit to relay coil 308 (Line 8). Contacts 308-2 (Line 13) and 308-3 (Line 6) are opened and contacts 308-1 (Line 14) are now closed by relay coil 308. The opened contacts 308-2 cut off power to relay coil 311 (Line 13) to open contacts 311-1 and 311-2 (Line 11). Solenoid 107 (FIG. 5) then shifts hydraulic valve spool 202 to neutral position to stop cylinder 18 closing slide gate 11.

When contacts 308-1 close, relay coil 312 (Line 14) becomes energized and closes contacts 312-1 and 312-2 (Line 10) which in turn energize solenoid 109. The energized solenoid 109 then shifts hydraulic spool 203 to extend cylinder 34. Extending cylinder 34 moves linkage 33, 24 and 25 to raise drop sleeve 21. As linkage 33 moves away from limit switch 102 towards limit switch 103, power to relay coil 305 (Line 7) is cut off. The relay coil 305 then opens contacts 305-1 (Line 22) and 305-2 (Line 23) and closes contacts 305-3 (Line 21).

When the drop sleeve 21 is fully raised, linkage 33 contacts limit switch 103, which in turn opens the circuit to relay coil 304 (Line 6). The coil then opens contacts 304-3 (Line 14) and the circuit to relay coil 312 is opened. The coil then opens contacts 312-1 and 312-2 (Line 10) to cut off power to solenoid 109, causing the hydraulic valve spool 203 to shift to the neutral position. With the valve spool in neutral position, cylinder 34 stops raising drop sleeve 21. As relay coil 304 opens contacts 304-3, it simultaneously opens contacts **304-1*a* and 304-2*a* (Line 2) also. After the other hoppers empty and their drop sleeves are raised, contacts 304-1*b*, 304-2*b*, 304-1*c*, and 304-2*c* (Lines 2 and 3) open in the same manner contacts 304-1*a* and 304-2*a* were opened. Now there is no power to solenoid 101 (Line 2). Hydraulic valve spool 201 shifts to extend cylinder 110 up against contact arms 47 on all hoppers. This locks all the probe arms 35 against the hopper walls 3** and the hoppers are now ready to be refilled for charging the next oven.

Another feature included in FIG. 6 is a push button 313 (Line 15) to close the slide gate 11 and raise the drop sleeve 21 regardless of what contacts are opened or closed. When the button 313 is pushed and either contacts 304-4 (Line 15) or 308-3 (Line 16) are closed, relay coil 314 is energized. Pushing button 313 also, simultaneously, opens the circuit to relay coil 302, thereby opening contacts 302-1 and 302-2 (Line 18) to cut off power to Lines 17 through 24 (FIG. 6). Relay coil 313, when energized, closes contacts 314-1 (Line 14) and 314-2 (Line 16), thus completing circuits (Lines 13 and 14 of FIG. 6) to close slide gate 11 and raise the drop sleeve 21. This feature permits an operator to interrupt a discharging cycle at any time, and close slide gate 11 and raise drop sleeve 21 in preparation for moving the larry car away, in case of an emergency.

It is desirable to have contacts 315-1 (between Lines 14 and 15) and 315-2 (Line 12) in the circuitry, in order to prevent the drop sleeve and slide gate circuitry from being activated while the car is travelling. These contacts are opened and closed by a relay coil (not shown) wired to the larry car travel controls. Contacts 315-1 are open, and contacts 315-2 are closed when the larry car is in motion. Contacts 315-1 are closed and contacts 315-2 are open when the car is spotted for charging.

We claim:

1. In a batch charging hopper for granular material having a top charging opening, sidewalls converging downwardly to form a bottom discharging opening, closure means for opening and closing said bottom discharge opening, an extension below said bottom discharging opening, and a movable drop sleeve telescoped on said extension, the improvement comprising:

(a) a pivotable probe arm extending downwardly within said hopper adjacent a portion of the interior of said side wall and terminating in a lower end adjacent said bottom discharge opening and an upper end spaced upwardly from said lower end;

(b) pivot means connecting said upper end and said side wall for permitting said probe arm to pivot back and forth within said hopper;

(c) means for locking said probe arm adjacent said sidewall when said hopper is empty and for unlocking said probe arm after said hopper has been filled, to permit pivoting of said probe arm as said hopper empties;

(d) biasing means connected to said upper end for causing said probe arm to pivot away from said sidewall during discharge of said hopper when said hopper is substantially empty; and (e) electrical switch means activated by said probe arm for indicating when said hopper is empty.

2. The invention of claim 1 in which said probe arm has a first thickness dimension at said upper end sufficient to provide stiffness to said probe arm and tapering downwardly to a smaller second thickness dimension at said lower end to minimize obstruction to flow through said bottom discharge opening.

3. The invention of claim 2 in which said biasing means is a counterweight outside said hopper pivotable about said pivot means, attached to said upper end of said probe arm.

4. The invention of claim 3 in which said locking and unlocking means of subparagraph (c) comprises:

(a) mechanical linkage means for raising and lowering said drop sleeve;

(b) a cable connected at one end to said mechanical linkage means extending upwardly about a pulley located above said counterweight and connected at the other end to said biasing means, said cable having a length adjusted so that said cable locks said counterweight in a raised position and thereby locks said probe arm against said sidewall when said drop sleeve is in the raised position and unlocks said counterweight when said drop sleeve is in a lowered position thereby permitting said counterweight to pivot said probe arm away from said sidewalls when said hopper is empty.

5. The invention of claim 1 further including means for automatically closing said closure means and raising said drop sleeve after said electrical switch means is activated.

* * * * *